US008199058B2

(12) United States Patent
Johnson

(10) Patent No.: US 8,199,058 B2
(45) Date of Patent: Jun. 12, 2012

(54) ANTENNA SYSTEM WITH PIFA-FED CONDUCTOR

(76) Inventor: Greg F. Johnson, Aptos, CA (US)

( * ) Notice: Subject to any disclaimer, the term of this patent is extended or adjusted under 35 U.S.C. 154(b) by 349 days.

(21) Appl. No.: 12/576,779

(22) Filed: Oct. 9, 2009

(65) Prior Publication Data

US 2010/0090904 A1 Apr. 15, 2010

Related U.S. Application Data

(60) Provisional application No. 61/104,242, filed on Oct. 9, 2008.

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,452,558 B1 * 9/2002 Saitou et al. ..... 343/725
7,230,574 B2 6/2007 Johnson
7,298,339 B1 11/2007 Ollikainen
2002/0044091 A1 4/2002 Mikkola
2006/0284770 A1 * 12/2006 Jo et al. ..... 343/700 MS
2007/0069956 A1 3/2007 Ozkar

FOREIGN PATENT DOCUMENTS

WO 2005010157 A1 10/2005

OTHER PUBLICATIONS

PCT Search Report and Written Opinion mailed Dec. 4, 2009.

* cited by examiner

*Primary Examiner* — Dieu H Duong

(74) *Attorney, Agent, or Firm* — Briggs and Morgan, P.A.; John F. Klos

(57) ABSTRACT

A high efficiency antenna for the 824-960 MHz and/or 1710-2170 MHz frequency ranges including world cellular and ISM bands, for use primarily on wireless communications devices such as handsets. An antenna system may be integrated within a handset as a "pull-out" whip or as an internal antenna. The antenna uses an oriented PIFA-fed resonator working in conjunction with a ground plane conductor, which can be realized as the ground traces of the PCB printed circuit board and/or an extension of the ground plane of a wireless communication device. The antenna system when installed on a handset as a pull-out whip, requires approximately one-half the extended length of current pull-out antennas, thus improving the device's aesthetic and mechanical durability.

18 Claims, 7 Drawing Sheets

ANTENNA SYSTEM WITH PIFA-FED CONDUCTOR

RELATED APPLICATIONS

This application claims the benefit of provisional application Ser. No. 61/104,242, filed Oct. 9, 2008, and incorporated by reference herein.

BACKGROUND OF THE INVENTION

The present invention relates to antenna assemblies for hand-held radio frequency transmitters and more particularly to antenna assemblies for communications devices such as cellular telephones.

BACKGROUND OF THE INVENTION

Handsets used in the cellular communications industry benefit from optimum performance from antenna systems in order to maximize the two-way voice or data link between a remote base station and the handset. Most current cellphone antennas utilize either dipole, or half-dipole antennas, mounted external or internal to the handset, all of which may be susceptible to RF radio frequency loss to the hand and other inefficiencies related to their size and location on the handset.

For many modern environments, multiple signal bands are accessed by wireless communications devices. For example, a wireless communications device may access both the 824-960 MHz band and the 1710-2170 MHz band.

FIG. 19 depicts a prior art antenna system of a wireless communications device (WCD) 140 including a quarter wavelength conductor 142 which is fed at location 144 by a low impedance RF transmission line (not shown) against ground plane conductor 143. Ground plane conductor 143 may be formed by the ground traces of a printed circuit board (PCB) of a WCD, such as a cellular handset. A half-wavelength dipole antenna results with an extending portion of the antenna depicted with a length, L.

FIG. 20 illustrates another antenna system 140 of the prior art wherein the quarter wavelength whip conductor 145 is coiled to reduce its overall length.

FIG. 21 illustrates another antenna system 140 of the prior art wherein the quarter wave upper element is formed by a serpentine conductor 146 and fed at location 148 and junction 144. Location 148 is selected along conductor 146 to provide a good RF impedance match to a transmission line. Additional information may be found at U.S. Pat. No. 6,239,765, entitled *Asymmetric Dipole Antenna Assembly*, incorporated by reference herein.

FIGS. 22 and 23 illustrate a prior art WCD 170 which includes a planar inverted "F" antenna (PIFA) 180 shown schematically as mounted above ground plane conductor 183. Many PIFA designs have the PIFA end connected to the ground plane conductor 183 at location 187, which may be either of the two longitudinal ends of WCD 170. The PIFA antenna 180 overlays the ground plane conductor 183 and the PIFA free end (opposite location 187) is directed toward the opposite end 189 of the ground plane conductor 183.

A need remains for antenna systems providing wide VSWR voltage standing wave ratio bandwidth, high gain, and high efficiency. A need also remains for antenna systems providing such performance characteristics across multiple operating bands within a given environment.

SUMMARY OF THE INVENTION

An antenna system of the present invention utilizes a uniquely oriented PIFA-fed conductor which minimizes hand loss, provides a wide voltage standing wave ratio (VSWR) bandwidth, high gain, and with resulting higher efficiency than current antenna systems used on handsets.

One embodiment of an antenna system of the present invention includes a quarter-wavelength wire whip portion, fed as a planar-inverted-F against a ground-plane formed by ground traces on the printed circuit board (PCB) of a wireless communications device (WCD). The feed location of the antenna is located away from one longitudinal end of the WCD. This allows for a reduction in the length of the radiator/conductor that extents beyond the PCB's end, without reducing peak antenna gain, which in one example is approximately +2 dBi. The whip portion of the antenna which extends beyond the end of the WCD may be reduced in size by forming it into a serpentine or coiled, as opposed to a straight form. A maximum gain for these two reduced-size options is achieved by the serpentine form.

Another embodiment of an antenna system of the present invention includes a second PIFA-fed resonator with a top leg having an open section proximate to its free end. The open section may be defined as a bifurcated free end. The open section of the top leg permits a substantial reduction in the height of the top leg relative to a ground plane conductor of the WCD.

One object of the current invention is to provide frequency coverage over both the 824-960 MHz cellular band and the 1710-2170 MHz band.

An embodiment of the present invention includes a pair of PIFA-fed resonator elements to provide enhanced communication band coverage. An oriented PIFA-fed resonator having an open section may be used for communications bands in the 1710-2170 MHz frequency range. These bands are commonly used in cellphones manufactured for use for 3G or third generation cellphone networks.

Embodiments of the present invention include conducting elements which work in conjunction with the cellphone's printed circuit board (PCB) ground traces to provide frequency coverage within 824-960 MHz and/or 1710-2170 MHz. An embodiment of the present invention provides a complete antenna system for what is commonly referred to as a quad-band and 3G cellphone.

A device according to the present invention includes a WCD implemented for operation over single or multiple frequency-bands. An antenna may be incorporated within a WCD at the time of manufacture, or may be provided as an accessory or aftermarket item to be added to existing WCDs having an external antenna port. The antenna of the present invention is suitable for high-volume, low cost manufacturing.

Other objects of the present invention include: the provision of an antenna exhibiting high gain and a front-to-back ratio which is substantially greater than known antenna devices; the provision of an antenna suitable for integration within or upon a WCD; the provision of an antenna having wide bandwidth in one or more frequency bands; the provision of an antenna which radiates RF energy from a WCD preferentially away from a user thereof; the provision of an antenna promoting increased WCD battery life by reducing commanded RF power.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE DRAWINGS

Figure 1:
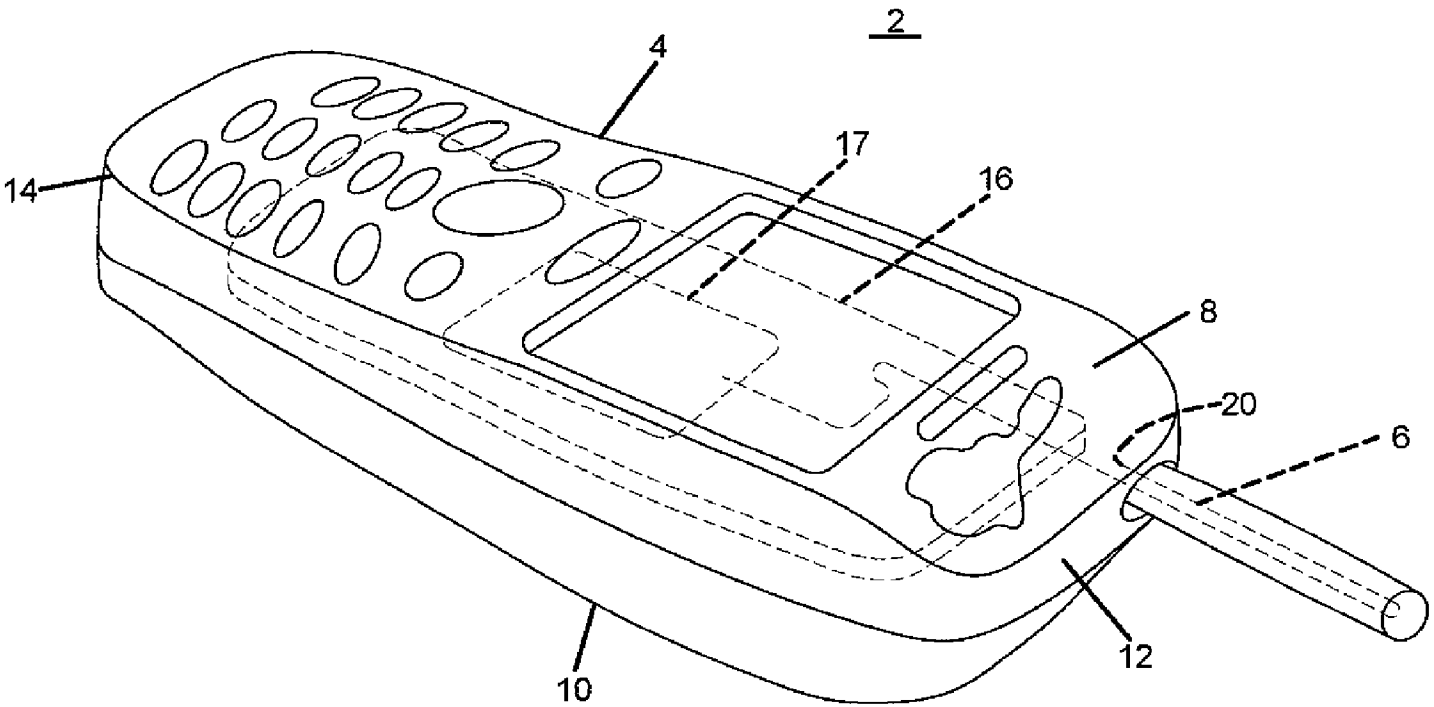
FIG. 1 is a perspective view of a wireless communications device utilizing an antenna system of the present invention.

Referring to FIG. 1, a device according to one embodiment of the present invention is indicated as numeral 2. Device 2 includes a portable wireless device "PWD" 4 and an antenna structure 6. Relative to a device user, in operation PWD 4 includes a front side 8 which is nearer to the user than a back side 10. PWD 4 has a top 12 and a bottom 14. In operation, bottom 14 is between top 12 and the ground surface upon which the user is positioned. PWD 4 is generally aligned in operation so that its top 12 is above a user's hand which grasps the PWD. PWD 4 includes a ground plane 16, typically a conductive plane within a printed wiring board upon which electronic components 17 are secured. Antenna structure 6 includes a ground plane element 16 and a configured radiating conductor (resonator) element 20. Resonator 20 may include a plurality of planar surfaces or may be configured to have some curvature or other shape. Resonator 20 maybe formed as a metal part or may be a plating or conductive layer disposed upon a support element. A portion of resonator 20 may be movably connected relative to the housing so that the portion can retract into the housing when not in use. As would be appreciated by one of ordinary skill in the art, signal generating components 17 included a variety of digital and/or analog components functioning to transmit, receive and process rf signals to and from PIFA resonator 20.

Figure 2:
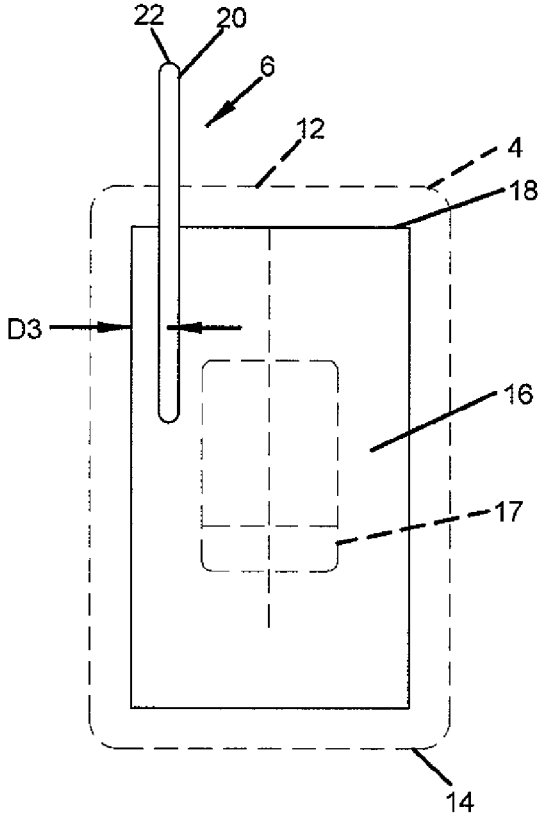
FIG. 2 is a top plan view of portions of an antenna system of a first embodiment of the present invention.
Figure 3:
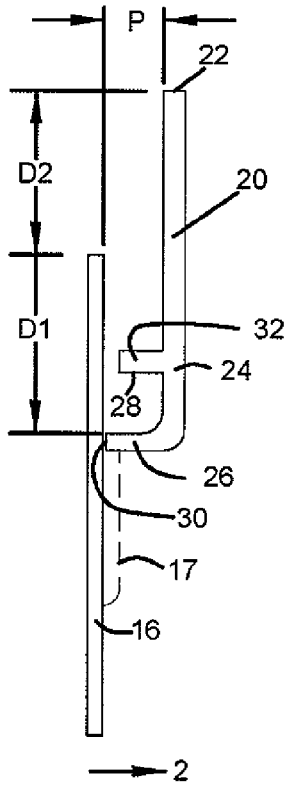
FIG. 3 is a side elevational view of the antenna system of FIG. 2.

FIGS. 2-9 illustrate single-band devices having an antenna system in accordance with the present invention. With reference to FIGS. 2 and 3, resonator 20 includes an upwardly directed conductor having a free end 22, a leg conductor 26, and a leg conductor 28. Leg conductor 26 is connected to ground plane 16 as indicated by numeral 30 on leg 26. A feedpoint 32, having a desired impedance, is defined upon leg conductor 28. Conductors 24, 26, 28 may be provided with differing widths and/or thicknesses. A coaxline or a microstrip or other type of transmission line may be used to couple the feedpoint to signal electronics of PWD 4. In operation, free end 22 is above leg elements 26, 28 relative to the ground surface upon which the device user is positioned. A top portion of resonator 20 is spaced away from ground plane 16 a distance "p". Distance "p" is measured in the Z dimension as shown. The length of resonator 20 (D1+D2) can be adjusted for resonance over the desired frequency range.

Figure 19:
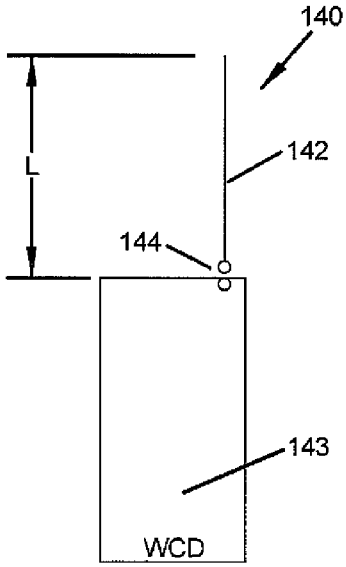
FIG. 19 PRIOR ART
FIGS. 19-23 illustrate various prior art antenna systems.
Figure 20:
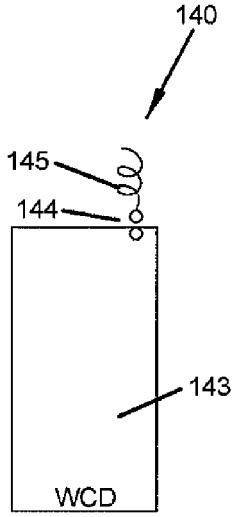
FIG. 20 PRIOR ART
Figure 21:
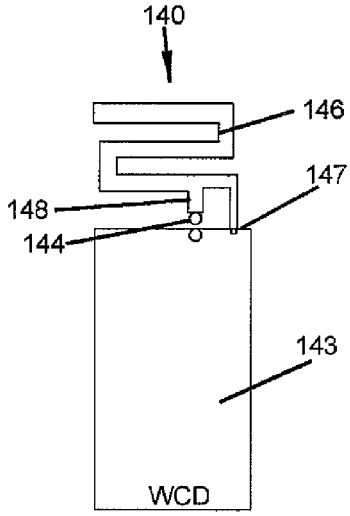
FIG. 21 PRIOR ART
Figure 22:
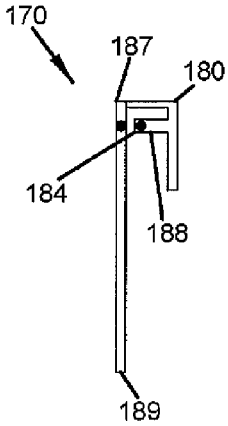
FIG. 22 PRIOR ART
Figure 23:
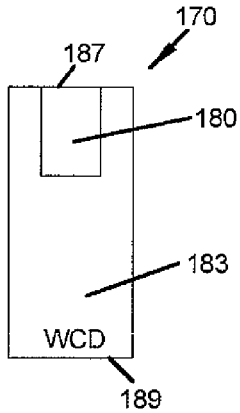
FIG. 23 PRIOR ART

FIGS. 2 and 3 depict a quarter wavelength resonator 20 which is PIFA-fed at location 32, with one end connected to the ground plane conductor 16 at location 30. Ground plane conductor 16 may be defined as a conductive ground layer(s) or ground trace on a printed circuit board (PCB). Location 30 is considerably removed from end 18 of ground plane conductor 16, and distance D1 is approximately 40% of the total length of resonator 20. Exposed length D2 is approximately 2 inches, for operation over 824-960 MHz, which is approximately half the length, L, of the whip antenna from FIG. 19. This provides a much more compact antenna which is less susceptible to breakage during use on a WCD handset. In preferred embodiments of the antenna system, D1 is between 20%-40% of the length (D1+D2) of the resonator 20.

In the embodiment of FIGS. 2 and 3, separation distance P may be relatively small, typically ¼ inch or less. A distance D3 between a lateral edge of the ground plane conductor 16 and resonator 20 may be in the range of 0 to the complete width of ground plane conductor 16. In one embodiment, resonator 20 may be a pull-out component wherein it is stored completely within the length of ground plane conductor 16 when not deployed.

Figure 4:
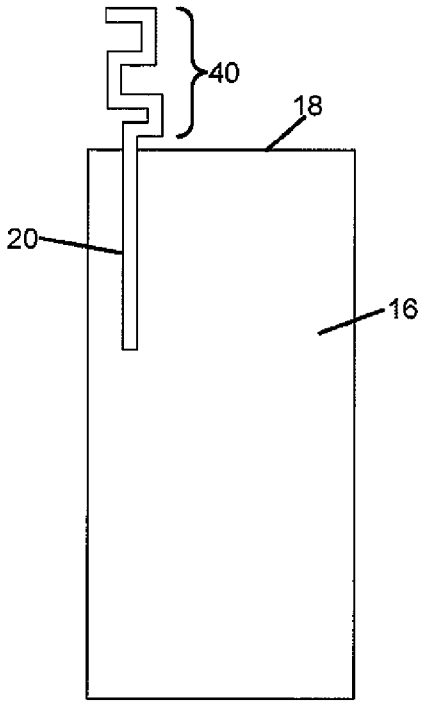
FIG. 4 is a top plan view of portions of an antenna system of a second embodiment of the present invention.
Figure 5:
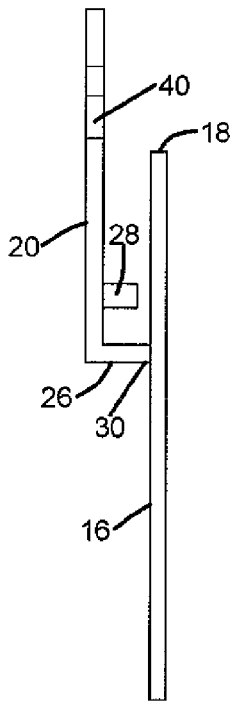
FIG. 5 is a side elevational view of the antenna system of FIG. 4.

Referring to FIGS. 4 and 5, another embodiment of an antenna system of the present invention is shown. In this embodiment, the external whip is formed into a serpentine shape 40 which may have a length of less than 1 inch for over the range of 824-960 MHz.

Figure 6:
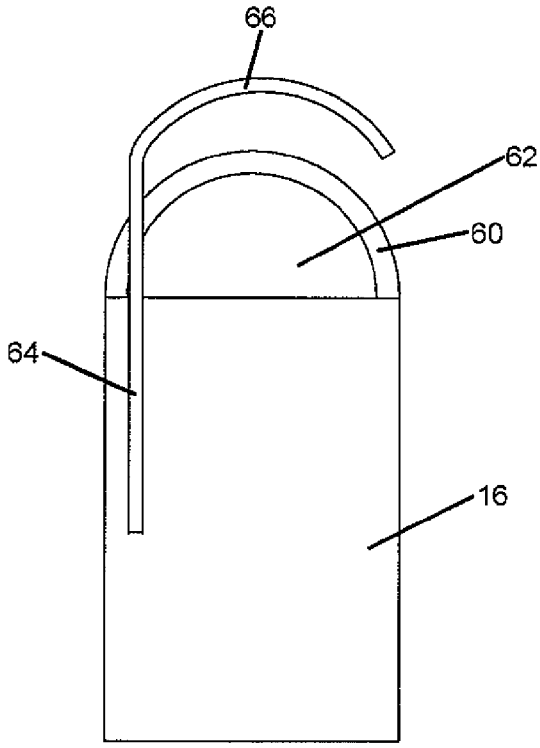
FIG. 6 is a top plan view of portions of an antenna system of a third embodiment of the present invention.
Figure 7:
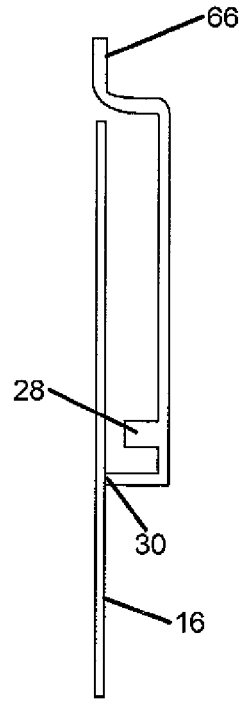
FIG. 7 is a side elevational view of the antenna system of FIG. 6.

Referring to FIGS. 6 and 7, another embodiment of an antenna system of the present invention is shown. Ground plane conductor 16 has a loop extension 60 defining an aperture 62 in ground plane conductor 16. Quarter wavelength conductor 64 is PIFA-fed a distance from one end of ground plane conductor 16. A portion of conductor 64 is formed to be in the same plane as loop 60 generally in the region designated by numeral 66.

Figure 8:
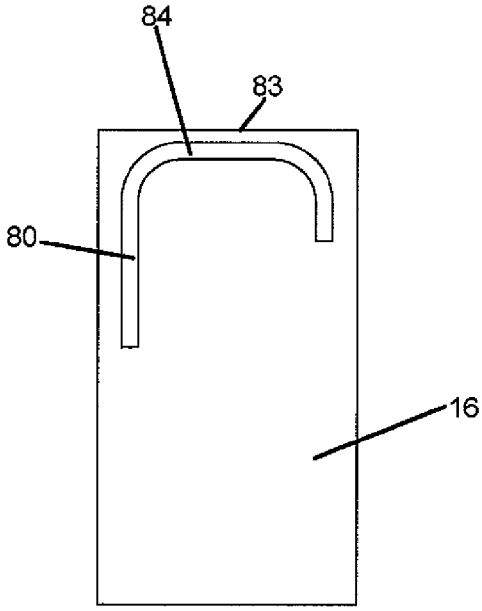
FIG. 8 is a top plan view of portions of an antenna system of a forth embodiment of the present invention.
Figure 9:
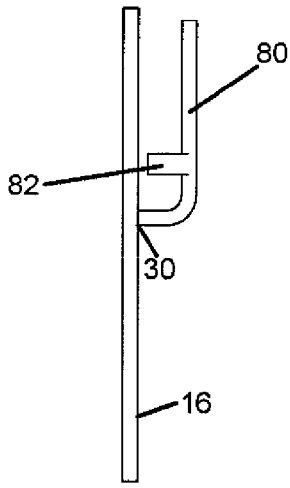
FIG. 9 is a side elevational view of the antenna system of FIG. 8.

Referring to FIGS. 8 and 9, yet another embodiment of an antenna system of the present invention is shown. Conductor 80 is again PIFA-fed at location 82 and connected to ground plane conductor 16 some distance down from an end of ground plane 16. In this embodiment, conductor 80 is formed parallel to an upper edge 83 of ground plane conductor 16 over a portion 84 of its length.

Figure 10:
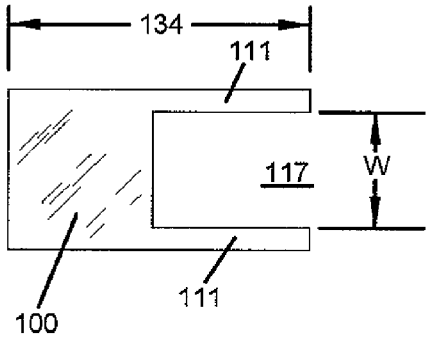
FIG. 10 is a top plan view of portions of an antenna system of a fifth embodiment of the present invention.
Figure 12:
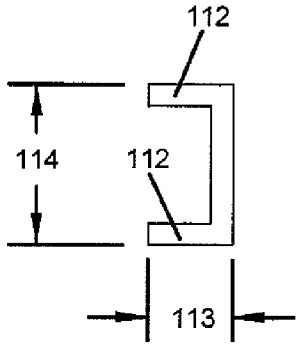
FIGS. 11 and 12 are side elevational view of the antenna system portions of FIG. 10.
Figure 11:
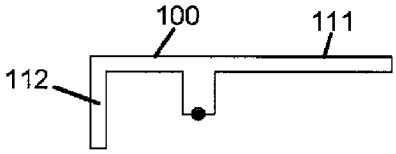
Figure 13:
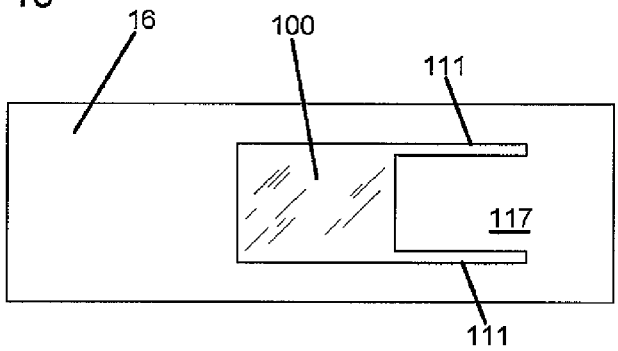
FIG. 13 is a top plan view of an antenna system of a sixth embodiment of the present invention.
Figure 14:
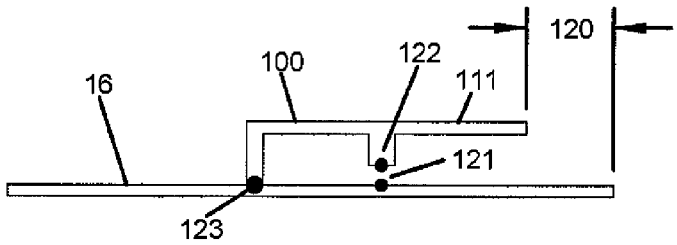
FIG. 14 is a side elevational view of the antenna system of FIG. 13.

FIGS. 10-12 illustrate top, end and side views of a resonator portion 100 of an antenna system utilizing a PIFA-fed resonator. FIGS. 13-14 illustrates top and side elevational views of an antenna system utilizing resonator portion 100. The antenna system is particularly well suited for operation over the frequency range of 1710-2170 MHz. Top legs 111 may have a width in the range of 0.03-0.2 inch, with a preferred width of 0.1 inch. Width 114 may be in the range of 0.3-1 inch, with a preferred value of 0.62 inch. Height 113 may be in the range of 0.2-0.8 inch, with a preferred value of 0.3 inches. Legs 112 may have a width in the range of 0.03-0.31 inch. As shown, the top portion of resonator 100 is bifurcated to define ends 111. Length 134 is in the range of 1.2-1.8 inches, with a preferred length of 1.5 inches. Section 117 is open. The length of conducting sheet portion 100 is in the range of 0.2-1.2 inches, with a preferred value of 0.83 inch. It is believed that open section 117 permits a substantial reduction in height 113 while maintaining desired antenna performance characteristics. This reduction in height permits PIFA resonator 100 to be installed in a wider range of compact wireless communications devices relative to prior art antenna systems.

As shown in FIGS. 13-14, a low impedance RF feed point 121 is provided between locations 122 and ground plane conductor 16. PIFA resonator 100 is electrically connected to ground plane conductor 16 at location 123. Distance 120 may be in the range of 0.5-1.5 inches, with a preferred value of 1.0 inch.

Figure 17:
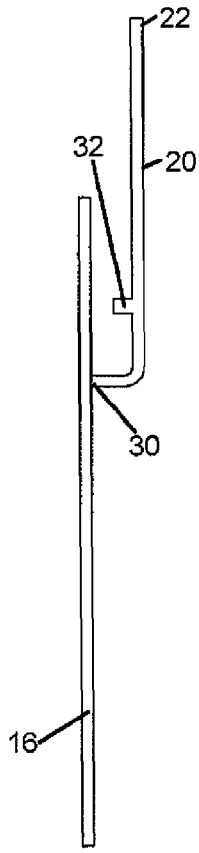
FIGS. 16 and 17 are side elevational view of the antenna system of FIG. 15.
Figure 15:
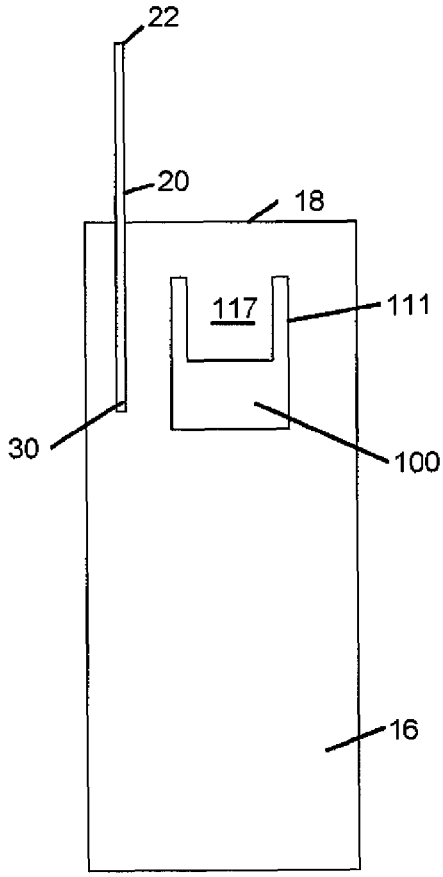
FIG. 15 is a top plan view of an antenna system of a seventh embodiment of the present invention.
Figure 16:
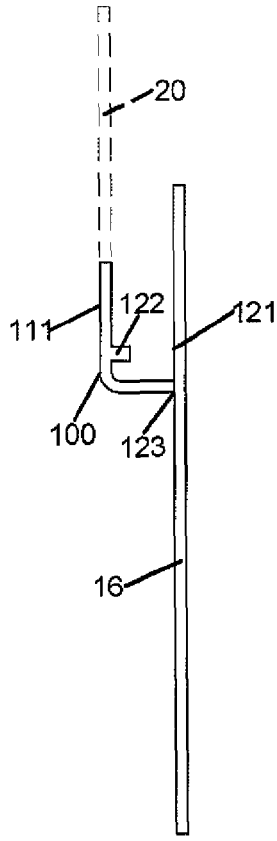

Referring to FIGS. 15-17, a plan and two side views depict a pair of PIFA-fed antenna resonator portions 20, 100 for separate frequency bands, which may be installed on the ground plane 16 of a wireless communications device such as a cell phone. A PIFA-fed antenna 20 for a lower frequency band is shown on the left side of the device's ground plane in the plan view, and in the left side view. A PIFA-fed antenna 100 for a higher frequency band is shown centered on the device's ground plane 16 in the plan view, and in the right side view.

Figure 18:
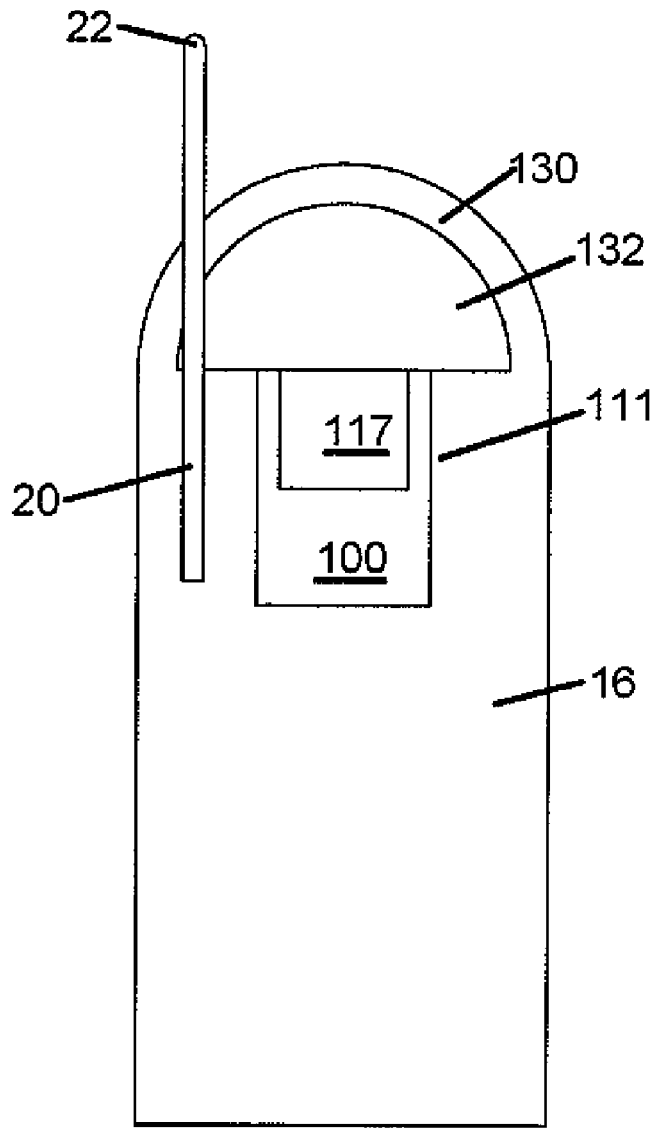
FIG. 18 is a top plan view of an antenna system of an eighth embodiment of the present invention.

Referring to FIG. 18, a plan view of an alternative configuration for the antenna combination of FIGS. 15-17 is shown. Ground plane 16 includes an extension portion 130 defined around an opening 132. Additional aspects of embodiments of the present invention may be found in application Ser. No. 61/104,255, entitled *Antenna System Having Compact PIFA Resonator with Open Sections*, and incorporated by reference herein. Additional aspects of embodiments of the present invention and information relating to PIFA antenna systems and wireless communications devices may be found in U.S. Pat. No. 7,230,574, entitled *Oriented PIFA-type device and method of use for reducing RF interference*, incorporated by reference herein.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An antenna system for a wireless communications device comprising:

a ground plane conductor defined at least by portions of a printed wiring board of the wireless communications device, said ground plane conductor defining a pair of longitudinal ends;

a first PIFA-fed resonator having a ground end and a free end, with said ground end being electrically coupled to the ground plane conductor at a ground point located a distance away from one of the pair of longitudinal ends, and with the resonator defining a feed point within the region between the ground point and said one longitudinal end, wherein at least a portion of the resonator between the feed point and the free end overlays the ground plane conductor and another portion of the resonator extends beyond said one of said pair of longitudinal ends of the ground plane conductor; and a second PIFA-fed resonator having a ground end and a free end, with said ground end being electrically coupled to the ground plane conductor at a ground point located a distance away from said one of said pair of longitudinal ends, and with the resonator defining a feed point within the region between the ground point and said one of said pair of longitudinal ends, and with the free end defining a pair of end portions separated by an open portion, with the pair of end portions being positioned between said one of said pair of longitudinal ends and said feed point of said second PIFA-fed resonator.

2. The antenna system of claim 1 wherein said portion of the first PIFA-fed resonator which extends beyond said one of said pair of longitudinal ends is between 60%-80% of an overall length of the resonator as measured in a longitudinal direction.

3. The antenna system of claim 1 wherein said portion of the first PIFA-fed resonator extending beyond said one of said pair of longitudinal ends of the ground plane conductor is coiled or formed into a serpentine shape.

4. The antenna system of claim 1 wherein said portion of the first PIFA-fed resonator which extends beyond said one of said pair of longitudinal ends is movable to be stored within a housing of the wireless communications device when not in use.

5. An antenna system for a wireless communications device comprising:

a ground plane conductor defined at least by portions of a printed wiring board of the wireless communications device, said ground plane conductor defining a pair of longitudinal ends, and said ground plane conductor having an apertured-extension portion proximate to one of said pair of longitudinal ends;

a first PIFA-fed resonator having a ground end and a free end, with said ground end being electrically coupled to the ground plane conductor at a ground point located a distance away from said one of said pair of longitudinal ends, and with the resonator defining a feed point within the region between the ground point and said one of said pair of longitudinal ends, wherein at least a portion of the resonator between the feed point and the free end overlays the ground plane conductor and another portion of the resonator extends across the apertured-extension portion of the ground plane conductor; and a second PIFA-fed resonator having a ground end and a free end, with said ground end being electrically coupled to the ground plane conductor at a ground point located a distance away from said one of said pair of longitudinal ends, and with the resonator defining a feed point within the region between the ground point and said one of said pair of longitudinal ends, and with a free end defining a pair of end portions separated by an open portion, with the pair of end portions being positioned between said one of said pair of longitudinal ends and said feed point of said second PIFA-fed resonator.

6. The antenna system of claim 5 wherein the portion of the first PIFA-fed resonator extending across the apertured-extension portion is bent and generally contained within the same plane as the ground plane conductor.

7. The antenna system of claim 5 wherein said portion of the first PIFA-fed resonator which extends across said apertured-extension portion is between approximately 60% -80% of an overall length of the resonator.

8. An antenna system for a wireless communications device comprising:

a ground plane conductor defined at least by portions of a printed wiring board of the wireless communications device, said ground plane conductor defining a pair of longitudinal ends;

a first PIFA-fed resonator having a ground end and a free end, with said ground end being electrically coupled to the ground plane conductor at a ground point located a distance away from said one of said pair of longitudinal ends, and with the resonator defining a feed point within the region between the ground point and said one of said pair of longitudinal ends, wherein at least a first portion of the resonator between the feed point and the free end overlays the ground plane conductor and a second resonator portion, longer than said first portion, extends beyond said one of said pair of longitudinal ends; and a second PIFA-fed resonator having a ground end and a free end, with said ground end being electrically coupled to the ground plane conductor at a ground point located a distance away from said one of said pair of longitudinal ends, and with the resonator defining a feed point within the region between the ground point and said one of said pair of longitudinal ends, and with a free end defining a pair of end portions separated by an open portion, with the pair of end portions being positioned between said one of said pair of longitudinal ends and said feed point of said second PIFA-fed resonator.

9. The antenna system of claim 8 wherein said second portion of the first PIFA-fed resonator is approximately 60% of an overall length of the resonator as measured in a longitudinal direction.

10. The antenna system of claim 8 wherein said second portion of the first PIFA-fed resonator is coiled or formed into a serpentine shape.

11. The antenna system of claim 8 wherein said second portion of the first PIFA-fed resonator is movable to be stored within a housing of the wireless communications device when not in use.

12. An antenna system for a wireless communications device comprising:

a ground plane conductor defined at least by portions of a printed wiring board of the wireless communications device, said ground plane conductor defining a pair of longitudinal ends;

a first PIFA-fed resonator having a ground end and a free end, with said ground end being electrically coupled to the ground plane conductor at a ground point located a distance away from one of the pair of longitudinal ends, and with the resonator defining a feed point within the region between the ground point and said one longitudinal end, wherein at least a portion of the resonator between the feed point and the free end overlays the ground plane conductor and another portion of the resonator extends beyond said one of said pair of longitudinal ends of the ground plane conductor; and a second PIFA-fed resonator having a ground end and a free end, with said ground end being electrically coupled to the ground plane conductor at a ground point located a distance away from said one of said pair of longitudinal ends, and with the resonator defining a feed point within the region between the ground point and said one of said pair of longitudinal ends, and with a free end defining a pair of end portions separated by an open portion, with the pair of end portions being positioned between said one of said pair of longitudinal ends and said feed point of said second PIFA-fed resonator.

13. The antenna system of claim 12 wherein said portion of the first PIFA-fed resonator which extends beyond said one of said pair of longitudinal ends is between approximately 60%-80% of an overall length of the resonator as measured in a longitudinal direction.

14. The antenna system of claim 12 wherein said portion of the first PIFA-fed resonator extending beyond said one of said pair of longitudinal ends of the ground plane conductor is coiled or formed into a serpentine shape.

15. The antenna system of claim 12 wherein the feed point of the first PIFA-fed resonator is defined upon a resonator leg portion extending from a top portion of the first PIFA-fed resonator toward the ground plane conductor.

16. The antenna system of claim 12 wherein the open portion of the second PIFA-fed resonator is defined between a pair of generally parallel end portions.

17. The antenna system of claim 12 wherein the second PIFA-fed resonator is generally centered with respect to a longitudinal axis of the ground plane conductor and the first PIFA-fed conductor is offset relative to said longitudinal axis.

18. The antenna system of claim 17 wherein the ground points of the first and second PIFA-fed resonators are generally a same distance from said one of said pair of longitudinal ends.

* * * * *